US008843021B2

(12) United States Patent
Li

(10) Patent No.: US 8,843,021 B2
(45) Date of Patent: Sep. 23, 2014

(54) TONER CARTRIDGE SEAL REFURBISHMENT SYSTEM AND METHOD

(71) Applicant: Clover Technologies Group, LLC, Ottawa, IL (US)

(72) Inventor: Jun Li, Walnut, CA (US)

(73) Assignee: Clover Technologies Group, LLC, Ottawa, IL (US)

( * ) Notice: Subject to any disclaimer, the term of this patent is extended or adjusted under 35 U.S.C. 154(b) by 0 days.

(21) Appl. No.: 14/067,101

(22) Filed: Oct. 30, 2013

(65) Prior Publication Data

US 2014/0119771 A1 May 1, 2014

Related U.S. Application Data

(60) Provisional application No. 61/720,185, filed on Oct. 30, 2013.

(51) Int. Cl.
*G03G 15/00* (2006.01)
*G03G 15/08* (2006.01)

(52) U.S. Cl.
CPC ..... *G03G 15/0898* (2013.01); *G03G 15/0894* (2013.01); *G03G 15/0812* (2013.01)
USPC ..... 399/109

(58) Field of Classification Search
CPC ..... G03G 2215/00987
USPC ..... 399/103, 105, 106, 109
See application file for complete search history.

(56) References Cited

U.S. PATENT DOCUMENTS

| | | | | |
|---|---|---|---|---|
| 5,134,960 | A * | 8/1992 | Shirai | 399/105 |
| 5,650,841 | A * | 7/1997 | Matsuda et al. | 399/111 |
| 8,139,975 | B2 | 3/2012 | Hayashida et al. | |
| 8,627,981 | B2 * | 1/2014 | Perry et al. | 220/657 |
| 2003/0231907 | A1 * | 12/2003 | Okamoto | 399/284 |
| 2011/0139158 | A1 * | 6/2011 | Xue et al. | 128/206.15 |
| 2014/0119771 | A1 * | 5/2014 | Li | 399/109 |

* cited by examiner

*Primary Examiner* — WB Perkey
(74) *Attorney, Agent, or Firm* — Mathew G. Gavronski

(57) ABSTRACT

A sealing system and method for a remanufactured toner cartridge is provided. The remanufactured toner cartridge includes a first fixed portion, a second fixed portion spaced from the first fixed portion, and a seal having a fixed end, a free end, an engaging side, and a non-engaging side. An elongated member is inserted between the first fixed portion and the non-engaging side of the seal, and urges the engaging side of the seal into sealing engagement with the second fixed portion.

16 Claims, 2 Drawing Sheets

TONER CARTRIDGE SEAL REFURBISHMENT SYSTEM AND METHOD

CROSS REFERENCE TO RELATED APPLICATION

This application claims the benefit of and priority to U.S. Provisional Patent Application No. 61/720,185, filed Oct. 30, 2012, the entire contents of which are hereby incorporated by reference herein.

BACKGROUND

Toner cartridges for laser printers include a toner reservoir for storing toner that can be transferred to print media during printing operations. To transfer the toner from the reservoir to the print media, some toner cartridges use a toner supply roller positioned at least partially in the toner reservoir. The toner supply roller picks up toner from the reservoir and transfers it to a development roller. A metering blade regulates the toner amount on the development roller surface. The development roller presents electrically charged and metered toner to the photoconductor for transfer during the image development process. Developed toner then transfers either directly or via other components within the printing apparatus onto the print media.

To control movement of the dry, powdery toner, the toner reservoir is typically sealed off by the metering blade and one or more resilient seals. The blades typically ride against or closely adjacent to rollers such as the development roller to provide a toner-tight seal. The seals may be provided between non-moving structural components and can be used to close off or seal interfaces between various parts that make up the toner cartridge. An example of a toner cartridge that uses resilient seals and blades for sealing the toner reservoir is disclosed in U.S. Pat. No. 8,139,975, the entire contents of which are hereby incorporated by reference herein.

During toner cartridge remanufacturing, the toner cartridge may be at least partially disassembled and cleaned, refilled with toner, and parts of the toner cartridge also may be replaced. To minimize cost and complexity of the remanufacturing process, it may be desirable to reuse as many toner cartridge components as possible.

SUMMARY

In some aspects, a sealing system for a remanufactured toner cartridge is provided and includes a first fixed portion, a second fixed portion spaced from the first fixed portion, a seal having a fixed end, a free end, an engaging side, and a non-engaging side, and an elongated member inserted between the first fixed portion and the non-engaging side of the seal. The elongated member urges the engaging side of the seal into sealing engagement with the second fixed portion.

The seal may be a previously-used component of the remanufactured toner cartridge and the elongated member may be a new component that is added to the remanufactured toner cartridge. The fixed end of the seal may be fixedly coupled to the first fixed portion. The second fixed portion may comprise a doctor blade frame, and the system may further comprise a doctor blade coupled to the doctor blade frame. The non-engaging side of the seal may be in communication with a toner reservoir of the remanufactured toner cartridge. The elongated member may be substantially circular, and may have a diameter that is between 10% and 35% greater than a diameter of a reference circle inscribed between a point on the non-engaging side of the seal and two additional contact points before insertion of the elongated member.

In other aspects, a remanufactured toner cartridge is provided and includes a housing having opposite ends, and a seal extending substantially continuously between the ends of the housing. The seal includes a fixed end, a free end, an engaging side, and a non-engaging side. The remanufactured toner cartridge also includes an elongated member extending substantially continuously between the ends of the housing. The elongated member engages the non-engaging side of the seal and urges the engaging side of the seal into sealing engagement with a fixed portion of the remanufactured toner cartridge.

The seal may be a previously-used component of the remanufactured toner cartridge and the elongated member may be a new component that is added to the remanufactured toner cartridge. The fixed portion of the remanufactured toner cartridge may be a second fixed portion, and the remanufactured toner cartridge may further comprise a first fixed portion that may be spaced from the second fixed portion. The elongated member may be inserted between the non-engaging side of the seal and the first fixed portion. The fixed end of the seal may be fixedly coupled to the first fixed portion. The housing may define a toner reservoir, and the non-engaging side of the seal may be in communication with the toner reservoir. The elongated member may be substantially circular, and may have a diameter that is between 10% and 35% greater than a diameter of a reference circle inscribed between a point on the non-engaging side of the seal and two additional contact points before the elongated member is positioned for engagement with the non-engaging side of the seal.

In still other aspects, a method of remanufacturing a toner cartridge is provided and includes obtaining a previously used toner cartridge including a housing, a first fixed portion, a second fixed portion, and a seal, where the seal includes a fixed end, a free end, an engaging side, and a non-engaging side. The method also includes disassembling the toner cartridge, and inserting an elongated member between the non-engaging side of the seal and the first fixed portion. The method further includes reassembling the toner cartridge to engage the engaging side of the seal with the second fixed portion, such that the elongated member urges the engaging side of the seal into sealing engagement with the second fixed portion.

The method may further comprise selecting the elongated member to have an outer diameter that is between 10% and 35% greater than a diameter of a reference circle inscribed between a point on the non-engaging side of the seal and two additional contact points before the elongated member is positioned for engagement with the non-engaging side of the seal.

Figure 1:
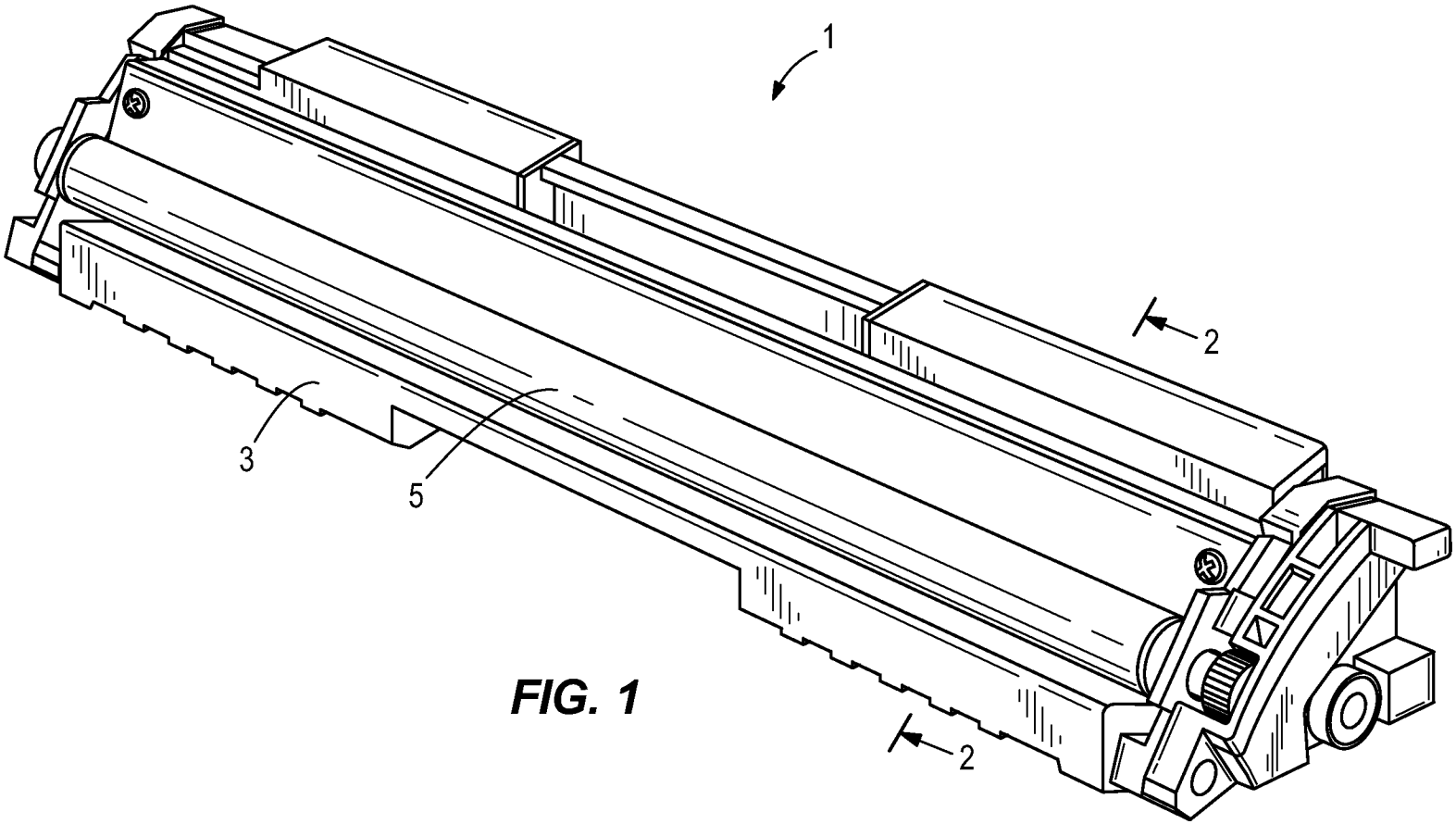
FIG. 1 is a perspective view of a toner cartridge.

While the subject matter of this disclosure can be practiced and carried out in many different ways, certain embodiments are shown in the drawings and described in detail with the understanding that such drawings and description are exemplary in nature and are not intended to limit the scope of the invention set forth in the claims only to those embodiments that are illustrated and described.

DETAILED DESCRIPTION

FIG. 1 is a perspective view of a toner cartridge 1 that may be refurbished in accordance with the present teachings. The toner cartridge 1 includes a housing 3 that rotatably supports an electrophotographic photosensitive drum 5. During operation, the electrophotographic photosensitive drum 5 is charged, loaded with toner, and cleaned using known electrophotographic processes. The various seals, blades, rollers, and the toner itself used during the electrophotographic process are directly or indirectly supported by the housing 3. The toner may be stored in a dedicated toner reservoir that may be sealed off from other portions of the housing 3.

Figure 2:
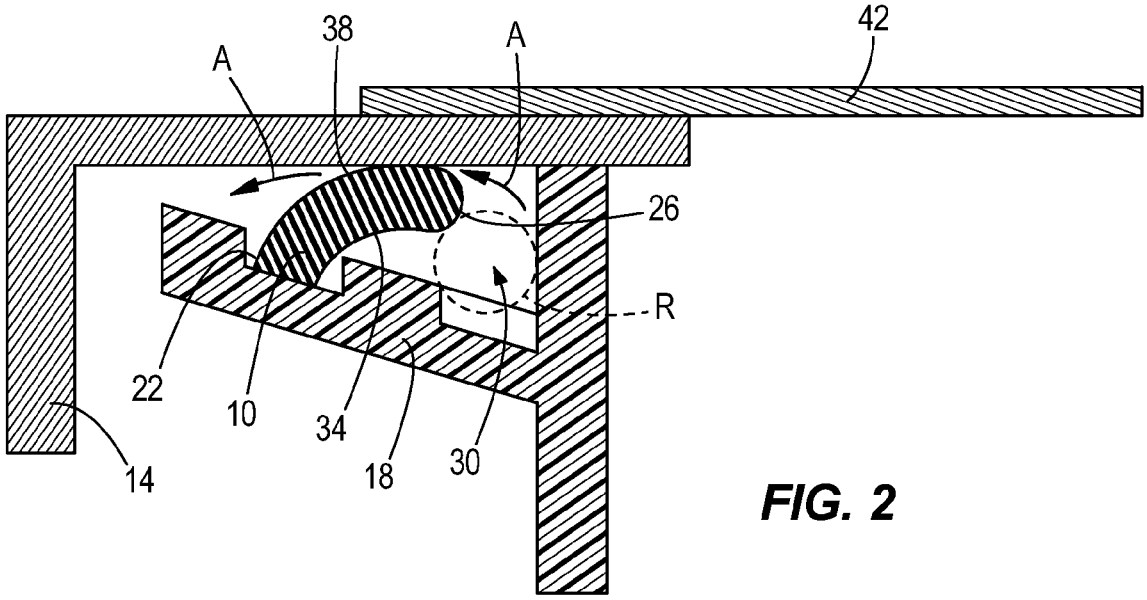
FIG. 2 is a section view taken along line 2-2 of FIG. 1 and showing a portion of the toner cartridge before implementing a refurbishment system and method according to one embodiment.

During toner cartridge remanufacturing, the resilient seals and blades for sealing the toner reservoir may be worn to such an extent that they no longer adequately seal the toner reservoir. This can allow toner to leak from the toner reservoir, which can be messy and can degrade print quality. For example, and with reference to FIG. 2, a resilient seal 10 can be positioned between a doctor blade frame 14 and a support portion 18 of a toner reservoir in a toner cartridge. In the illustrated configuration, the seal 10 has a fixed end 22 coupled to the support portion 18 and a free end 26 opposite the fixed end 22. A chamber 30 located on a non-engaging side 34 of the seal 10 is in open communication with the toner reservoir and, as such, toner can freely flow into and accumulate in the chamber 30. An engaging side 38 of the seal 10 engages the doctor blade frame 14 and, at least when the toner cartridge is relatively new, seals the chamber 30 to prevent the escape of toner past the seal 10. In this configuration, the support portion 18 provides a first fixed portion to which the seal 10 is coupled, and the doctor blade frame provides a second fixed portion that is engaged by the free end 26 of the seal 10. The first and second fixed portions may be formed as part of the housing 3, or may be other components of the cartridge 1 that are supported by the housing 3. A doctor blade 42 is coupled to the doctor blade frame 14 and engages a development roller (not shown) to similarly limit the unwanted escape of toner from the toner reservoir, it being understood that the doctor blade 42 and the development roller are configured so the development roller can extract some toner from the toner reservoir for subsequent application to the print media.

As the toner cartridge wears, the seal 10 can become worn and can lose some of its resiliency. As a result, the free end 26 of the seal may not engage the doctor blade frame 14 with a force sufficient to prevent the escape of toner from the chamber 30. In this regard, toner may pass between the engaging side 38 of the seal 10 and the doctor blade frame 14, as suggested by the arrows A in FIG. 2. This problem can become more pronounced during a remanufacturing process, where the toner cartridge 1 may be disassembled and the seal 10 may be reassembled with a different doctor blade frame 14.

Figure 3:
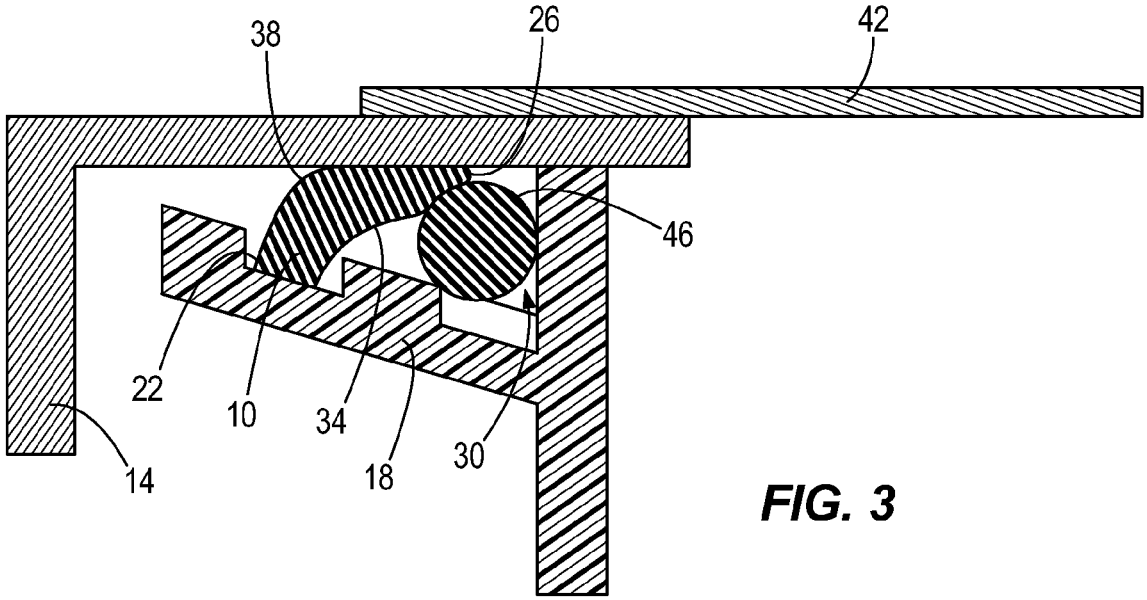
FIG. 3 is a section view similar to FIG. 2 showing the portion of the toner cartridge after implementing the refurbishment system and method.

Referring also to FIG. 3, to improve the effectiveness of the seal 10 in a remanufactured print cartridge, an elongated member 46 may be inserted between the non-engaging side 34 of the seal 10 and a fixed portion of the toner cartridge, such as, for example, the support portion 18. In the illustrated configuration, the elongated member 46 engages the seal 10 and the support portion 18 to which the seal 10 is fixedly coupled. In other configurations, the elongated member 46 may engage the seal and another fixed portion of the remanufactured toner cartridge to which the seal 10 is not necessarily fixedly coupled. In still other configurations, the elongated member 46 may engage the seal, a fixed portion of the cartridge to which the seal 10 is fixedly coupled, and another component of the toner cartridge to which the seal 10 is not fixedly coupled. As shown in FIG. 3, the elongated member 46 presses the seal 10 more firmly against the doctor blade frame 14 such that an area of the seal 10 in contact with the doctor blade frame 14 is increased compared to the configuration of FIG. 2, which lacks the elongated member 46. In this way, the elongated member 46 functions to improve the integrity of the toner seal defined by the engagement of the engaging side 38 of the seal 10 with the doctor blade frame 14.

Depending on the specific assembly procedure, the elongated member 46 may be inserted before or after the engaging side 38 of the seal 10 is moved into engagement with the second fixed portion of the cartridge, such as the doctor blade frame 14 shown in the illustrated example. Upon installation of the elongated member and reassembly of the toner cartridge 1, the elongated member 46 assists the seal 10 by urging the engaging side 38 of the seal 10 more firmly against the second fixed portion, for example the doctor blade frame 14 in the illustrated embodiment, to reduce or prevent substantial escape of toner from the chamber 30 by passing between the engaging side 38 of the seal and the doctor blade frame 14.

Although a variety of materials and configurations may be suitable depending on the specific configuration, arrangement, and materials of the seal 10 and the support portion 18, in the illustrated embodiment the elongated member 46 is configured with a substantially circular cross section and is formed of a resilient foam cord. Other synthetic materials having various material properties also may be used, although some level of resiliency generally is preferred in order to accommodate slight variations in the seal 10 and support portion 18, both of which may be used components having been subjected to different operating conditions. Different cross sections may also be used for the elongated member 46. For example, the elongated member 46 may be provided with flat portions and/or ribs or ridges configured to fit against or within the surfaces of the support portion. A diameter of the elongated member 46 may be selected to provide a desired amount of compressive force against the non-engaging side 34 of the seal 10. For example, in some embodiments the diameter of the elongated member 46 may be between 10% and 35% greater than the diameter of a reference circle R (FIG. 2) inscribed between a point on the non-engaging side 34 of the seal 10 and two additional points of contact for the installed elongated member 10. In the illustrated embodiment, both additional points of contact are provided on the support portion 18, however other embodiments may be provided such that one or both of the additional points of contact are provided by a fixed component of the toner cartridge other than the support portion 18. The diameter of the reference circle R is determined by the relative location of the seal and the additional points of contact in the assembled toner cartridge 1 before insertion of the elongated member 46. In other embodiments the diameter of the elongated member 46 may be between 15% and 30% greater than the diameter of the R reference circle. In still other embodiments, the diameter of the elongated member 46 may be between about 20% and 25% greater than the diameter of the reference circle R.

Accordingly, upon installation of the elongated member 46 during the remanufacturing process, a sealing system is provided for refurbishing and sealing a portion of the remanufactured toner cartridge. The system includes the elongated member 46, which is insertable between the non-engaging side 34 of the seal 10 and at least a first fixed portion, such as the support portion 18, of the toner cartridge. The elongated member 46 urges an engaging side 38 of the seal 10 into sealing engagement with a second fixed portion, such as the doctor blade frame 14, of the toner cartridge 1. Those skilled in the art will appreciate that the seal 10 and the elongated member 46 extend substantially continuously between opposite ends of the housing 3 of the remanufactured toner cartridge 1.

The remanufacturing process, including installation of the elongated member 46, also provides a method for refurbishing and sealing a portion of the remanufactured toner cartridge. The method includes obtaining an appropriately configured, previously used toner cartridge having the seal 10, a first fixed portion, and a second fixed portion, where the seal 10 engages the second fixed portion. The cartridge 1 is disassembled to expose the seal 10, and may include moving the first fixed portion with respect to the second fixed portion. The method further includes inserting the elongated member 46 between the non-engaging side 34 of the seal 10 and the first fixed portion, which may be the support portion 18 of the toner cartridge 1. The engaging member 46 may be inserted or positioned before or after the first fixed portion of the cartridge having the seal 10 fixed thereto is reassembled or otherwise rejoined with the second fixed portion to move the engaging side 38 of the seal 10 into engagement with the second fixed portion, such as the doctor blade frame 14, of the toner cartridge 1. The method may also include replacing the photosensitive drum 5 and refilling the cartridge with toner.

While specific embodiments have been illustrated and described, numerous modifications come to mind without significantly departing from the spirit of the disclosure, and the scope of protection is to be limited only by the scope of the accompanying claims.

What is claimed is:

1. A sealing system for a remanufactured toner cartridge, the system comprising:

a first fixed portion;

a second fixed portion spaced from the first fixed portion;

a seal having a fixed end, a free end, an engaging side, and a non-engaging side; and, an elongated member inserted between the first fixed portion and the non-engaging side of the seal, the elongated member urging the engaging side of the seal into sealing engagement with the second fixed portion.

2. The sealing system of claim 1, wherein the seal is a previously-used component of the remanufactured toner cartridge and the elongated member is a new component that is added to the remanufactured toner cartridge.

3. The sealing system of claim 1, wherein the fixed end of the seal is fixedly coupled to the first fixed portion.

4. The sealing system of claim 1, wherein the second fixed portion comprises a doctor blade frame, the system further comprising a doctor blade coupled to the doctor blade frame.

5. The sealing system of claim 1, wherein the non-engaging side of the seal is in communication with a toner reservoir of the remanufactured toner cartridge.

6. The sealing system of claim 1, wherein the elongated member is substantially circular.

7. The sealing system of claim 6, wherein the elongated member has a diameter that is between 10% and 35% greater than a diameter of a reference circle inscribed between a point on the non-engaging side of the seal and two additional contact points before insertion of the elongated member.

8. A remanufactured toner cartridge comprising:

a housing having opposite ends;

a seal extending between the ends of the housing, the seal including a fixed end, a free end, an engaging side, and a non-engaging side; and, an elongated member extending between the ends of the housing, the elongated member engaging the non-engaging side of the seal and urging the engaging side of the seal into sealing engagement with a fixed portion of the remanufactured toner cartridge.

9. The remanufactured toner cartridge of claim 8, wherein the seal is a previously-used component of the remanufactured toner cartridge and the elongated member is a new component that is added to the remanufactured toner cartridge.

10. The remanufactured toner cartridge of claim 8, wherein the fixed portion of the remanufactured toner cartridge is a second fixed portion, the remanufactured toner cartridge further comprising a first fixed portion that is spaced from the second fixed portion, and wherein the elongated member is inserted between the non-engaging side of the seal and the first fixed portion.

11. The remanufactured toner cartridge of claim 10, wherein the fixed end of the seal is fixedly coupled to the first fixed portion.

12. The remanufactured toner cartridge of claim 8, wherein the housing defines a toner reservoir, and wherein the non-engaging side of the seal is in communication with the toner reservoir.

13. The remanufactured toner cartridge of claim 8, wherein the elongated member is substantially circular.

14. The remanufactured toner cartridge of claim 13, wherein the elongated member has a diameter that is between 10% and 35% greater than a diameter of a reference circle inscribed between a point on the non-engaging side of the seal and two additional contact points before the elongated member is positioned for engagement with the non-engaging side of the seal.

15. A method of remanufacturing a toner cartridge, the method comprising:

obtaining a previously used toner cartridge including a housing, a first fixed portion, a second fixed portion, and a seal, the seal including a fixed end, a free end, an engaging side, and a non-engaging side;

disassembling the toner cartridge;

inserting an elongated member between the non-engaging side of the seal and the first fixed portion; and, reassembling the toner cartridge to engage the engaging side of the seal with the second fixed portion, wherein the elongated member urges the engaging side of the seal into sealing engagement with the second fixed portion.

16. The method of claim 15, further comprising selecting the elongated member to have an outer diameter that is between 10% and 35% greater than a diameter of a reference circle inscribed between a point on the non-engaging side of the seal and two additional contact points before the elongated member is positioned for engagement with the non-engaging side of the seal.

* * * * *

UNITED STATES PATENT AND TRADEMARK OFFICE

CERTIFICATE OF CORRECTION

PATENT NO. : 8,843,021 B2
APPLICATION NO. : 14/067101
DATED : September 23, 2014
INVENTOR(S) : Jun Li It is certified that error appears in the above-identified patent and that said Letters Patent is hereby corrected as shown below:

On the title page item (60) in Related U.S. Application Data, Provisional application No. 61/720,185, filed on Oct. 30, 2013, should read Provisional application No. 61/720,185, filed on Oct. 30, 2012.

Signed and Sealed this
Thirtieth Day of December, 2014

Michelle K. Lee

Michelle K. Lee
*Deputy Director of the United States Patent and Trademark Office*